US006964417B2

(12) United States Patent
Bodish

(10) Patent No.: US 6,964,417 B2
(45) Date of Patent: Nov. 15, 2005

(54) WAR GAME AND METHOD OF PLAY

(76) Inventor: Brian K. Bodish, 1703 Concordia St., Pittsburgh, PA (US) 15210

( * ) Notice: Subject to any disclaimer, the term of this patent is extended or adjusted under 35 U.S.C. 154(b) by 0 days.

(21) Appl. No.: 10/435,573

(22) Filed: May 12, 2003

(65) Prior Publication Data

US 2004/0227292 A1 Nov. 18, 2004

(51) Int. Cl.[7] ..... A63F 3/00
(52) U.S. Cl. ..... 273/289; 273/255; 273/262
(58) Field of Search ..... 273/255, 262, 273/276, 288, 289; 446/69, 72, 97, 98, 99, 446/100, 101, 175, 219, 268, 385, 390, 376, 446/373

(56) References Cited

U.S. PATENT DOCUMENTS

| | | | | |
|---|---|---|---|---|
| 1,591,554 | A * | 7/1926 | Guion | 273/276 |
| 3,876,207 | A * | 4/1975 | Jones | 273/239 |
| 3,963,243 | A * | 6/1976 | Contento | 273/246 |
| 4,193,222 | A | 3/1980 | Deschand | |
| 4,207,702 | A | 6/1980 | Boatman et al. | |
| 4,924,358 | A | 5/1990 | Von Heck | |
| 5,388,837 | A * | 2/1995 | Hoffman | 273/262 |
| 5,480,341 | A | 1/1996 | Plakos | |
| 5,830,034 | A | 11/1998 | Ciechanowski et al. | |
| 5,893,562 | A * | 4/1999 | Spector | 273/349 |
| 5,941,712 | A * | 8/1999 | Smith | 434/365 |
| 6,165,038 | A | 12/2000 | Muller | |
| D439,544 | S | 3/2001 | Thill | |
| 2003/0020239 | A1 * | 1/2003 | Hagen et al. | 273/296 |

* cited by examiner

*Primary Examiner*—Vishu K. Mendiratta
(74) *Attorney, Agent, or Firm*—Carothers & Carothers

(57) ABSTRACT

A war game wherein multiple sets of moveable game figures are provided with each set having game player alignment identification indicia, such as different color glow, and each figure has removable and replaceable body parts which also glow in the dark so that the game may be played in the dark. Chance selection devices, such as dice and cards, are provided for chance selection of respective opponent players of body parts of the figures aligned with another opponent to be removed as an inflicted injury based upon designations indicated by this chance selection device or devices. The selection device is manipulated by the respective opponent players to sequentially chance select what opponent figure part is to be removed and then that particular body part, including armor and weapons, is removed from the opponent figure as directed by the selection device. Play is accordingly continued in this manner until all game figures are defeated by ultimate removal of a predesignated critical body part except for one or more remaining undefeated figures of a winning opponent player.

19 Claims, 8 Drawing Sheets

WAR GAME AND METHOD OF PLAY

FIELD OF THE INVENTION

The present invention relates generally to board games, and more particularly to game apparatus and method of play, including multiple sets of moveable game figures which may be dismembered and ultimately destroyed through opponent play with the use of chance selection. The war game is specifically designed to be played in the dark.

BACKGROUND OF THE INVENTION

Many war games are available for providing pleasure during leisure time. The war game of the present invention provides a different and unique game apparatus and method of play for providing new and exciting entertainment, all of which is described hereinafter.

SUMMARY OF THE INVENTION

The war game of the present invention is designed to provide added excitement by being playable in the dark. Skeletal figures composed of glow in the dark plastic are assembled and disassembled with body parts which are ruggedly constructed to snap together and apart over and over again, and all other playing components, including chance selection elements, game boards and figure accessories, are further constructed of glow in the dark material. The game, while being designed to be played in the dark, of course, need not necessarily be actually played in the dark.

The war game of the present invention in its most basic form is comprised of multiple sets of moveable game figures and each set has game player alignment identification indicia to identify with a particular opponent player of the game. These figures have removable and replaceable body parts. A chance selection device, such as dice and/or a chart, are provided for chance selection by respective opponent players of body parts of figures aligned with another opponent to be removed as dismemberment by an inflicted injury based upon designations indicated by this chance selection device. In this regard, the figures are therefore preferably constructed of rugged plastic so that the body parts may be snapped together and apart, over and over again, without damaging the figures. These body parts are also preferably constructed, at least in part, of luminescent or glow in the dark plastic so that the game may be played in the dark. As an additional element of excitement, the figures are also preferably skeletal figures.

The game figures also include body parts which are comprised of chemical light sticks. As one feature of the game, the chemical light sticks may be designated as critical body parts which when removed by an opponent player through playing by the game rules, thereby fatally injures the particular opponent figure. The chemical light sticks also add an eerie luminescent characteristic to the game figures and are provided in different colors for thereby also providing said player alignment identification indicia.

As an additional feature of the game, removed body parts on a player figure may be replaced but only by penalty with a concession such as giving up a player move or player points. This adds an additional exciting element to the game.

As an added dimension or feature of the war game of the present invention, the figures may also be provided with removable and replaceable armor and weapons which, during the playing of the game, are removed and replaced in the same manner as the body parts. These parts are also preferably luminescent.

Cards as additional chance selection devices may also be provided which have instructions thereon that effect the outcome of the game. For example, the cards may designate or impart, by chance, additional attributes to particular playing figures, such as, skill level, magical powers, armor or weapons.

The chance selection device may include, for example, dice used in combination with a chart that designates body parts of the figures to be removed based upon a number selected by the dice.

Although not required, an added dimension may be provided by including a game board for positioning and moving the game figures thereon.

By way of example, the inventor provides the game of the present invention in one form as skeletal war like ant figures and the game is designated or identified under the trademark SKELETANTS.

Thus the game figures are designated as Skeletants which are fighting for domination of a game board which represents a grid of the Skeletant Universe. Each player is designated as a Master and is provided with his or her own war board as a game board.

In this example, each player is further alternately or sequentially provided with two ten sided dice for chance selection. A chart is also provided for reference as to what body parts (including armor and weapons) of the opponents game figures are to be severed or removed as the result of the chance selection made with the dice. In addition, cards are chance selected for each skeletal ant game figure. These cards are designated by the inventor as Skill Cards which provide or impart game winning features or attributes to particular game figures by providing enhancement of skills, such as enhancement of martial arts knowledge or magical skills. In addition, other chance selection devices, such as cards may further be employed for reflecting particular playing figure armor and weapons and other special war items with which play figures will be provided with, in addition to learned skills and magic capabilities.

The ant like skeletal figures provide a very formidable game figure and their removable skeletal body parts are constructed of glow in the dark plastic which provides an eerie feeling to enhance the nature of the game. In addition, the light sticks, normally one or two, are interiorly provided within each ant skeletal figure and they form the core which houses the life force of the ant wherein the key for destruction lies. When the core in the form of the light stick is exposed and destroyed by ultimate chance selection through playing by the rules of the game, the particular ant warrior is then terminated. When all skeletal ant figures of one opponent party have been terminated, the winner is the remaining player having remaining game figures.

An example of the apparatus and playing method of the game of the present invention will be described hereinafter in detail.

BRIEF DESCRIPTION OF THE DRAWINGS

Other objects and advantages appear in the following description and claims. The accompanying drawings show, for the purpose of exemplification, without limiting the scope of the invention or appended claims, certain practical embodiments of the present invention wherein:

DETAILED DESCRIPTION OF PREFERRED EMBODIMENTS

Figure 10:
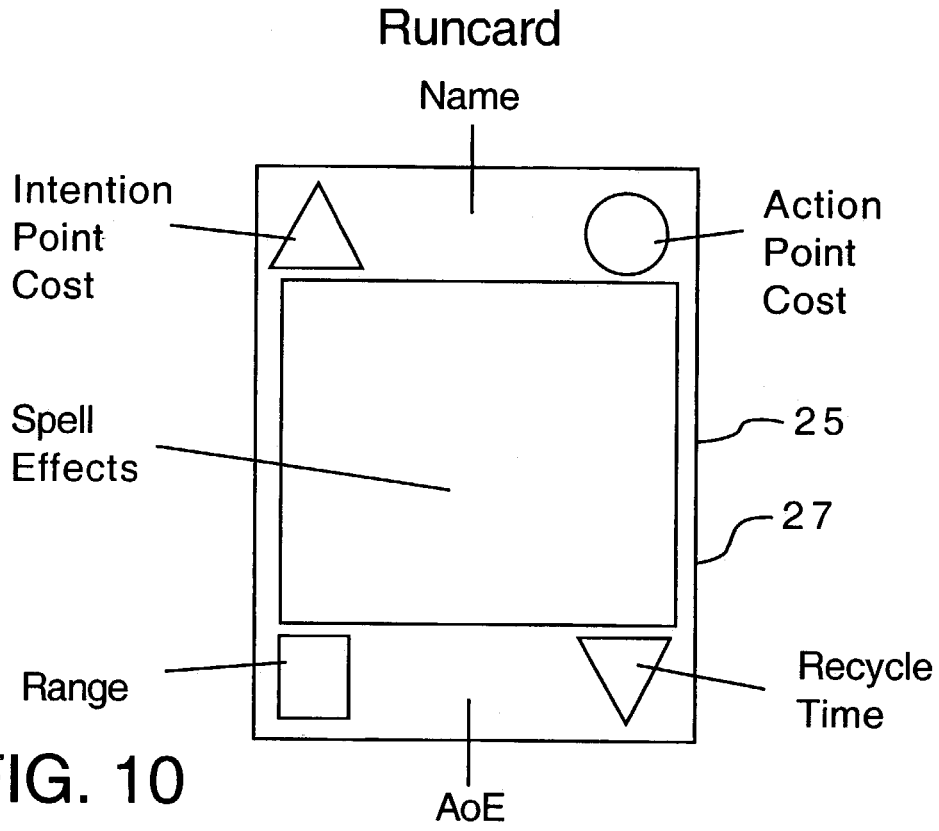

Referring first to FIGS. 1 through 5, the war game of the present invention utilizes multiple sets of moveable jointed game FIG. 10, which in the example illustrated is a skeletal ant like figure of approximately forty five snapped together body parts 11 molded of plastic which glow in the dark with a bright green glow. All of the body parts 11 are jointed and rotate at least 180° and other joints up to 360°. All of these body parts snap together and are easily removed one from the other and are replaceable in the same manner.

Many of the components are identical and therefore expense and manufacture is kept to a minimum. For example, all of the limb segments 12 are identical. Other parts include the four hands 13, two feet 14, head 15, chest cage 16 and abdomen 17.

Figure 1:
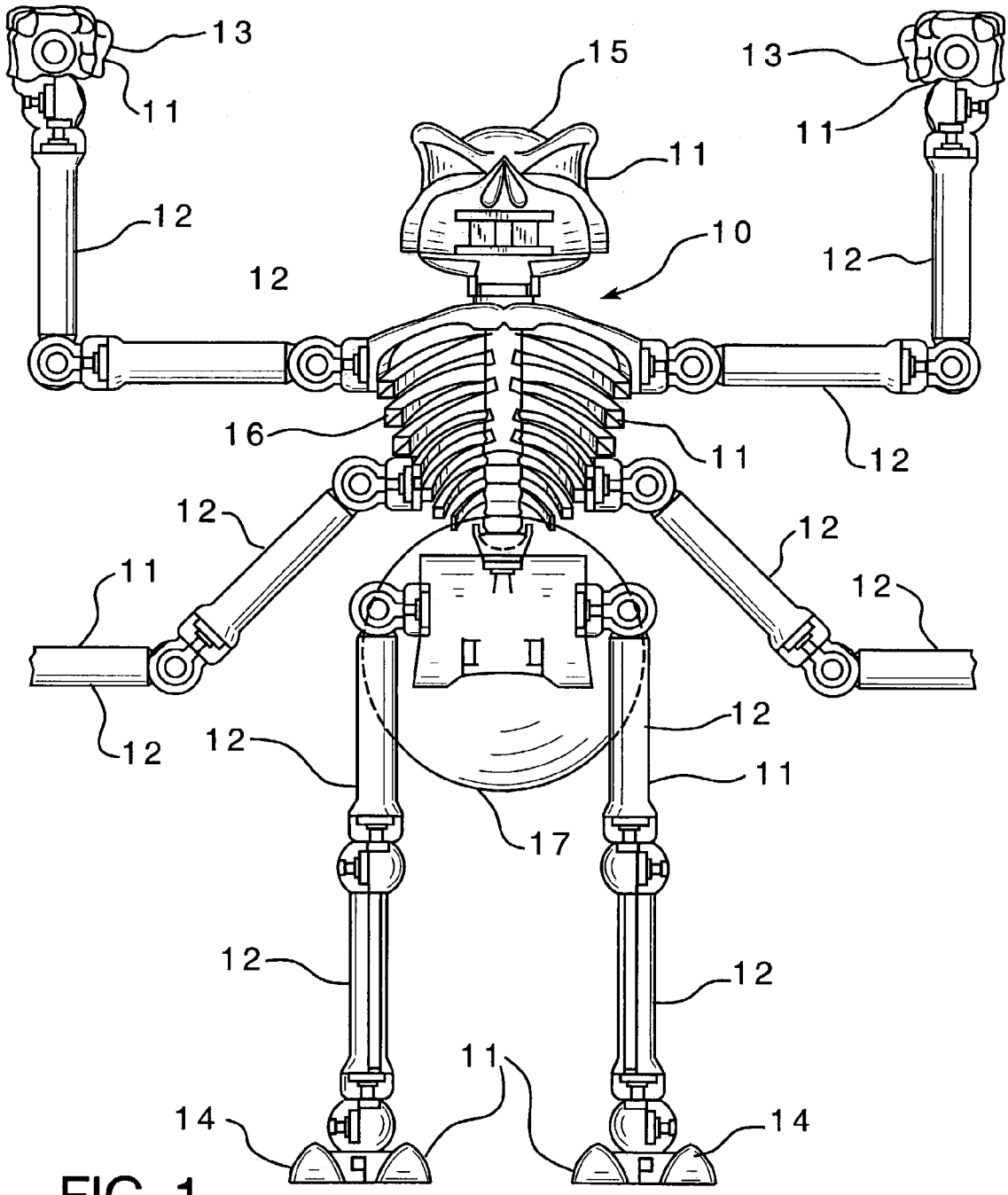
FIG. 1 is a view in front elevation illustrating one example of a movable jointed game figure for use in the war game of the present invention.
Figure 2:
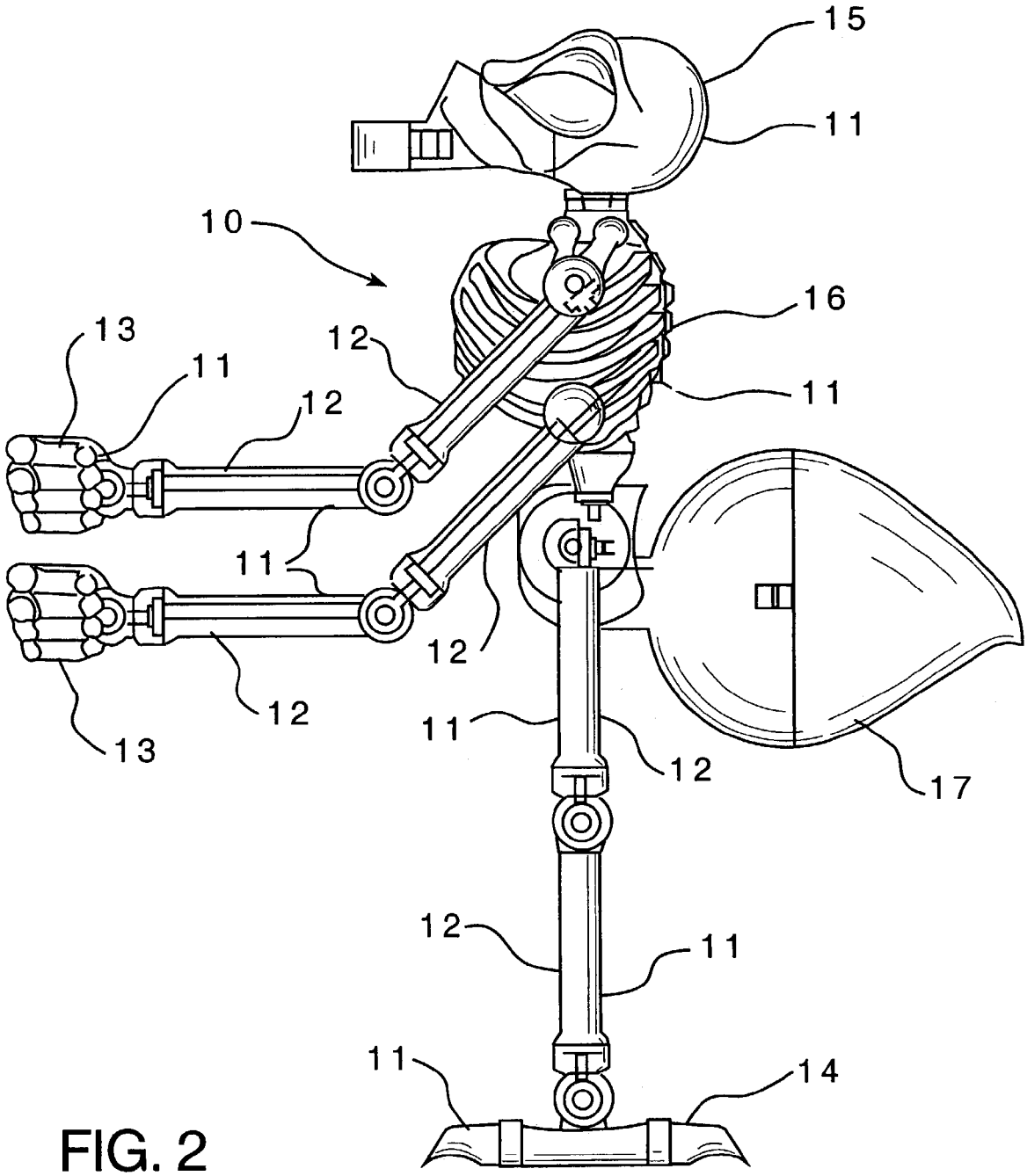
FIG. 2 is a view in left side elevation of the figure shown in FIG. 1 and with the upper arms of the game figure extended forward, instead of upwardly, as illustrated in FIG. 1.
Figure 3:
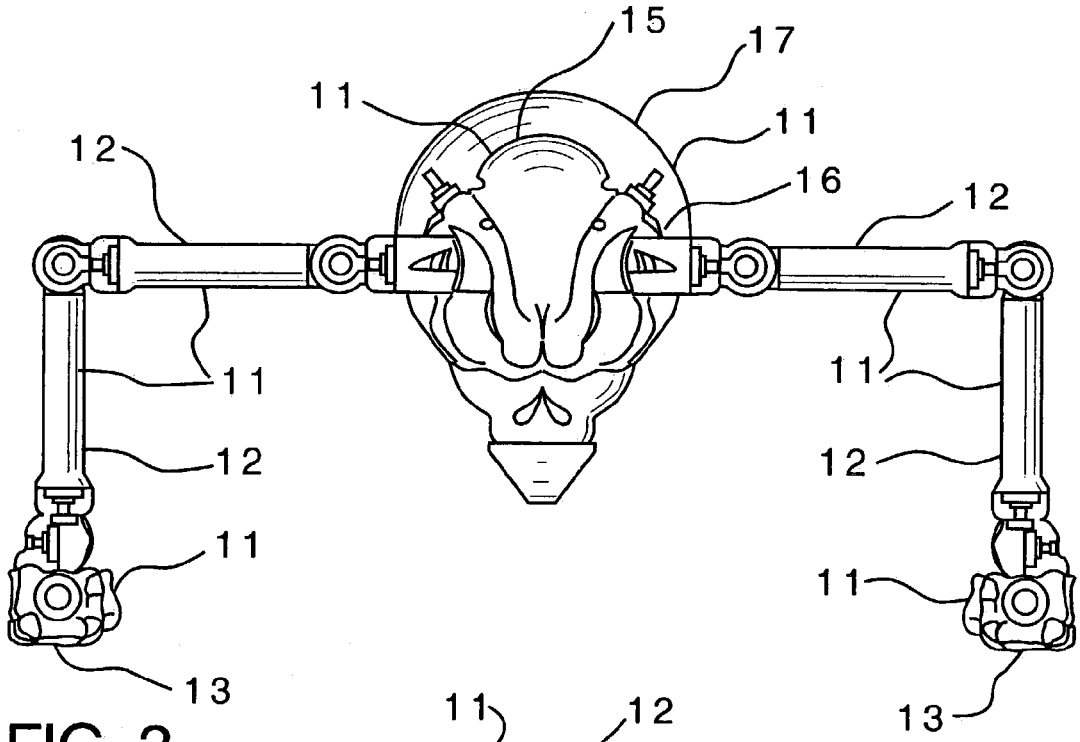
FIG. 3 is a top view of the figure shown in FIG. 2.
Figure 4A:
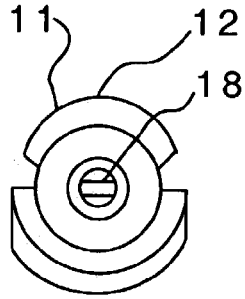
FIG. 4A is an enlarged left end view of the limb member shown in FIG. 4B.
Figure 4B:
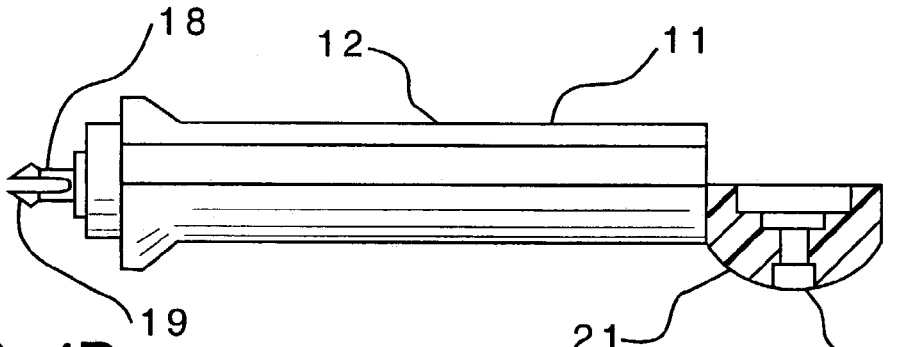
FIG. 4B is an enlarged view in side elevation of the limb member shown in FIG. 4A with an end joint member thereof shown in mid cross section.
Figure 5:
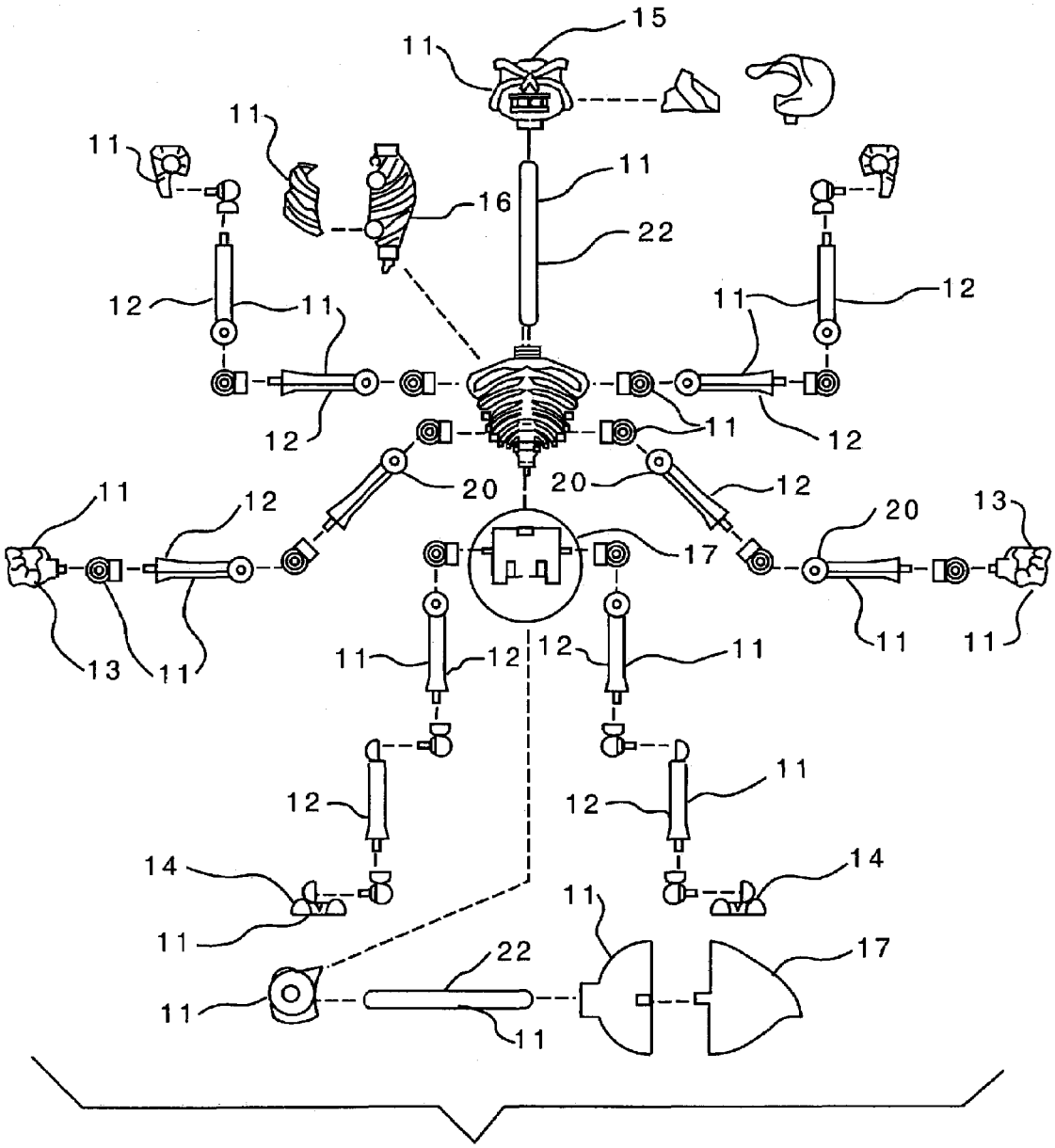
FIG. 5 is an exploded view of the game figure illustrated in FIGS. 1, 2 and 3 illustrating how the parts thereof snap together and are removable and replaceable.

The enlarged view of FIGS. 4A and 4B illustrate how the parts snap together and rotate. Here the limb 12 is provided on one end with a pronged male connector element 18 with an enlarged head 19 which is received with a snap fit in the joint cavity 20 of the female connector element 21 on a similar adjacent body part 11.

In addition to the external glow in the dark body parts already indicated, each game FIG. 10 is also provided with two nontoxic chemical glow sticks 22 which glow a predesignated color selected, for example, from blue, red or purple. These glow sticks are best illustrated in the expanded FIG. 5 and one of the glow sticks is received in the chest cage 16 and the other glow stick 22 is received inside the abdomen 17 wherein they provide an eerie color glow within the particular body part, which already glows externally with a bright green glow.

Game figures for different opponent players are provided with glow sticks of a different color in order to provide game player alignment identification indicia for the respective game FIG. 10. Thus, multiple sets of the moveable game FIGS. 10 are provided for respective opponent players with each set having game player alignment identification indicia in the form of the particular color given off by the glow sticks and all figures have removable and replaceable snap together body parts as is best illustrated in the exploded view of FIG. 5.

Chance selection is also provided for the players through the use of chance selection devices, such as, dice (not shown) or cards 25 as illustrated in FIGS. 7 through 10. When dice are employed, they are preferably comprised of a set of two or three ten sided dice, each incorporating the numbers one through ten on respective faces thereof. The dice (not shown) and the cards 25 are also made of or incorporate glow in the dark materials so that they may be identified and read in the dark as the game is being played.

Figure 6:
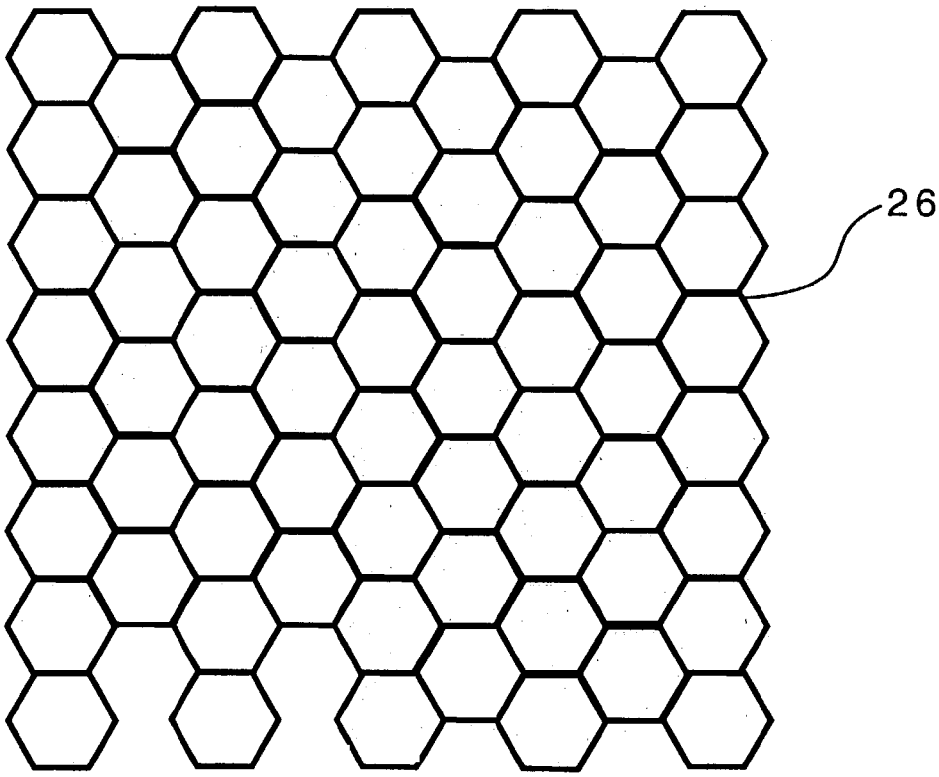
FIG. 6 is a plan view, reduced in size, of one example of a segment of a game board for use in playing the war game of the present invention.

A size reduced segment of the game board is illustrated in FIG. 6 and is made up of hexagonal side by side positions. This game board may be expanded by snapping together additional game boards of the same type. The hexagons are all marked or made with glow in the dark ink or material so that they are also readily visible in the dark. The game FIG. 10 are then positioned on predesignated portions of the game board 26 and the game FIG. 10 may be advanced or retracted on the game board with chance moves as designated by the dice and/or game cards or basic rules.

The game FIG. 10 need not be all identical and through point concession, purchase or chance designation, each figure may acquire other attributes, capabilities and body parts. In particular, these attributes are gained in the present example through the chance selection by the use of cards 25.

Figure 7:
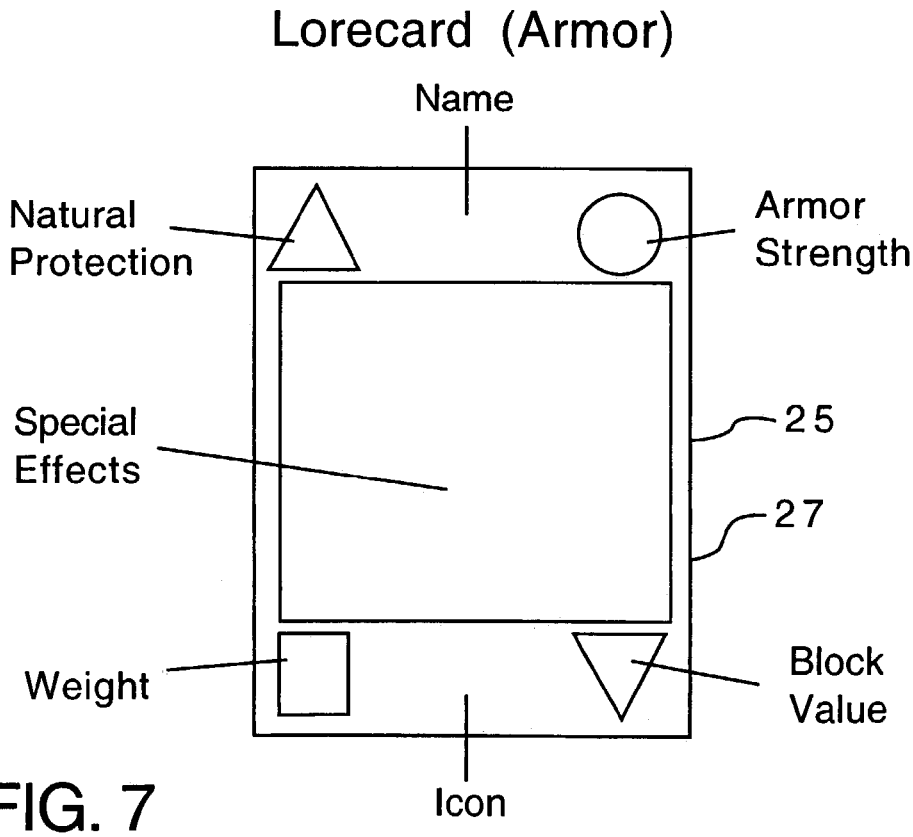
FIGS. 7, 8, 9 and 10 illustrate the face respectively of different Skillcards and Lorecards (armor and weapons) for use with the game of the present invention as one means of chance selection for thereby imparting special attributes to the associated game figures.

The Lorecards 27 of FIG. 7 designate armor selection. For example, by selecting a battle shield Lorecard, the game FIG. 10 may take on the attributes of the respective Lorecard which accompanies it, such as a battle shield 28 illustrated in FIGS. 12 and 13, or a helmet 30 as illustrated in FIG. 14 which is attached to the figure.

Figure 12:
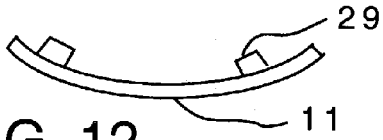
FIG. 12 is a top view of the hand shield shown in FIG. 13 for securement to a game figure as shown in FIGS. 1 through 4.
Figure 13:
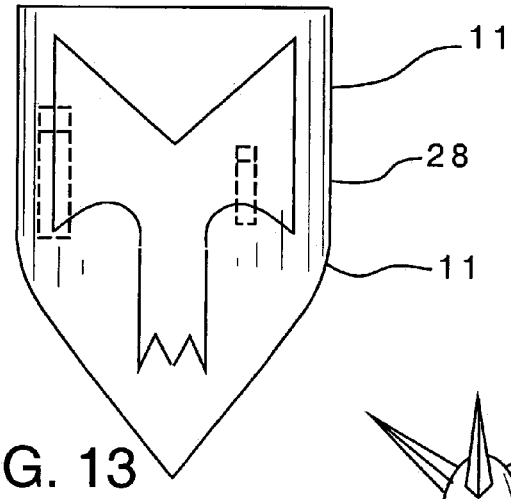
FIG. 13 is a view in front elevation of the hand shield shown in FIG. 12.
Figure 14:
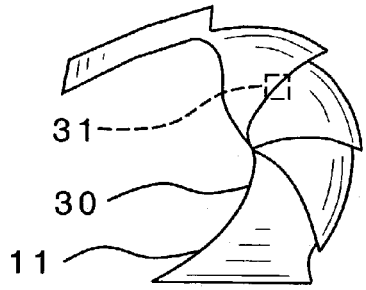
FIG. 14 is a view in side elevation of a helmet which may be secured to the head of the playing figure illustrated in FIGS. 1 through 4.

The shield 28 in FIGS. 12 and 13 is also made of glow in the dark plastic and is provided with clips 29 on the back thereof for attachment to the arm of a game FIG. 10. Similarly, the helmet 30 glows in the dark and is provided with a snap securement element 31 for attachment to the head 15 of one of the game FIG. 10.

Figure 15:
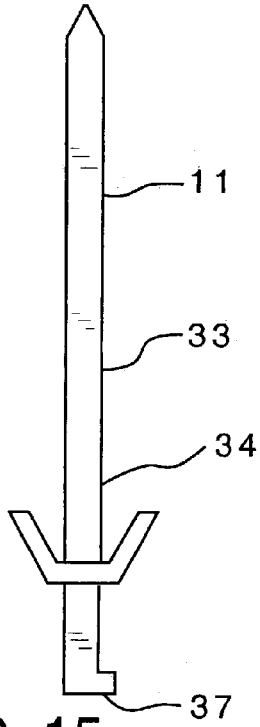
FIG. 15 is a view in front elevation showing a weapon in the form of a sword for securement to the playing figure shown in FIGS. 1 through 4.
Figure 16:
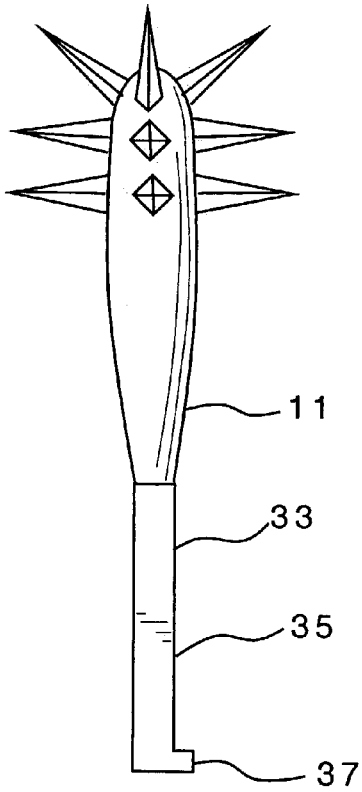
FIG. 16 is a view in front elevation of a spiked club weapon for securement to the hand of the playing figure illustrated in FIGS. 1 through 4.
Figure 17:
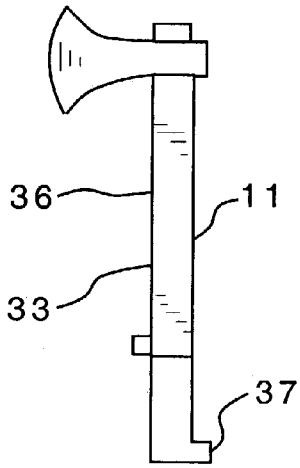
FIG. 17 is a view in side elevation of a hand axe weapon for securement to the hand of the playing figure illustrated in FIGS. 1 through 4.

In similar fashion, through purchase or chance selection made by each playing opponent, weapons 33 as seen in FIGS. 15, 16, 17, are selected for their game FIG. 10 and also a weapon Lorecard particular to that weapon and describe its gaming attributes. The weapon 33 shown in FIG. 15 is a sword 34, the weapon 33 in FIG. 16 is a spiked club 35 and the weapon 33 illustrated in FIG. 17 is a hand axe 36. Each of these weapons has a small protrusion 37 on the bottom of their respective handles so that the weapon may be attached to the hand of the designated game FIG. 10. Once again, these hand weapons, as is the case with the armor, are all made of glow in the dark material so that they may be readily seen in the dark. Each of the pieces of armor or weapons may be molded in different glow in the dark colors to signify the different power levels of the respective weapons.

Figure 9:
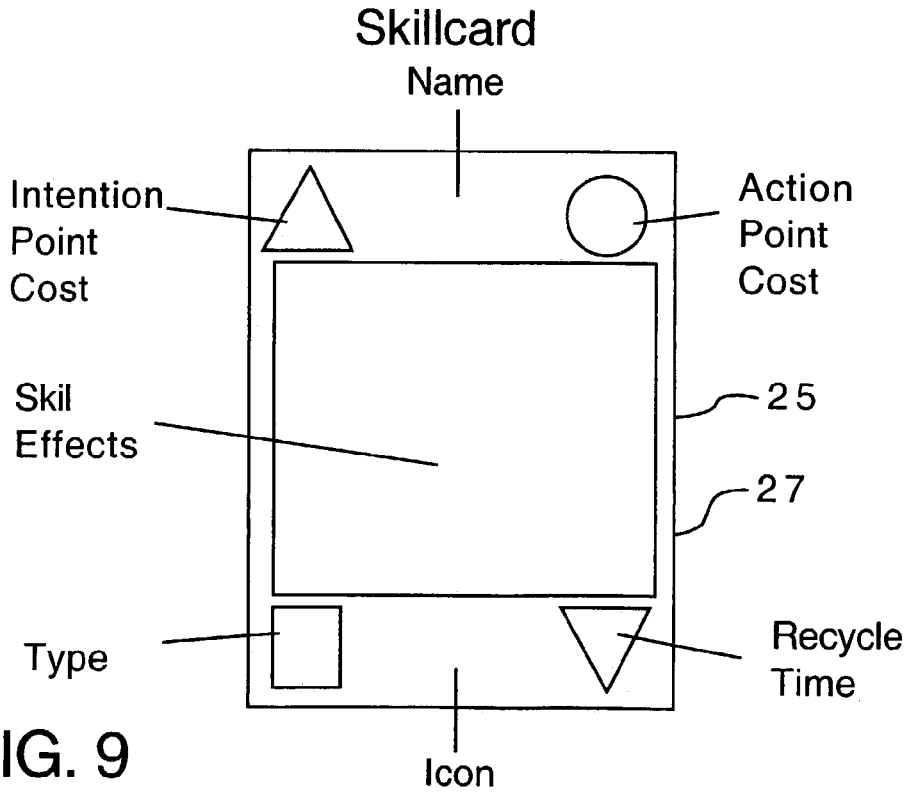
Figure 11:
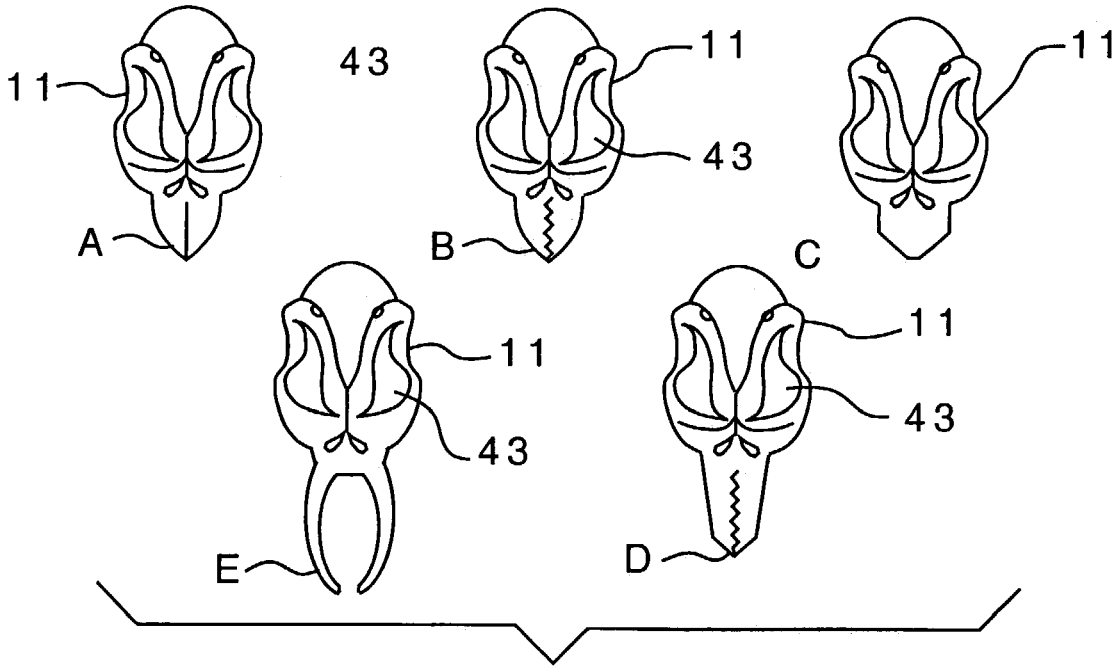
FIG. 11 illustrates five different replacement jaws for the figures illustrated in FIGS. 1 through 4 for representing different attributes of strength, rank and overall dominance of the respective figures which are purchased or made by chance selection.

Skillcards 40 shown in FIG. 9 provide chance selection of different skill levels and rule bending abilities for the respective game FIG. 10. The Skillcards designate or attribute the selected game figure with different skills, such as martial art skills. One way of designating the different skill levels and strength levels is to provide the particular game FIG. 10 with different jaws of different size which indicates respective strength, rank or overall dominance of the game figure. For example, as represented in FIG. 11, the jaw of the game FIG. 10 may be replaced with any one of the glow in the dark jaws illustrated in FIG. 11, the least dominant being that of the jaw configuration shown at A with increasing dominance being attributed by the jaw configurations respectively of B, C, D and E. As these different skill levels are attained through purchase by respective opponent game FIG. 10, the initial jaw configuration for the head 15 of the game figure may be snapped off and the jaw of increased skill snapped on to the figure. Once again, jaw configurations of FIG. 11 are made of glow in the dark plastic.

The Runecards 44 of FIG. 10 are purchased cards to indicate magical powers attributed to respective game FIG. 10 through the use of the cards 25. The use by an opponent player of one of these cards provides the player with the opportunity to impart his game FIG. 10 with mythical magical powers whereby the game figure can cast spells and hexes affective on opposing game figures as designated by the card selected.

Each of the cards 25 in FIGS. 7 through 10, respectively show what information is generally placed on the cards in the respective designated areas. An area is provided on each card 25 for the name of the respective attribute, its attack value and points that may cost the particular player for the opportunity to achieve this attribute and in the center of each card respective effects are designated. At the bottom of each card other information may be provided for the particular card attributes as is designated in the respective figures. For example, at the bottom of the Lorecard shown in FIG. 7, the term "Weight" represents the value of the weight of the object, the term "Icon" aids in identification of the armor, and the word "Block Value" is the value used to determine the blocking effectiveness of the particular piece of armor when the figure is attacked by an opponent figure.

Figure 8:
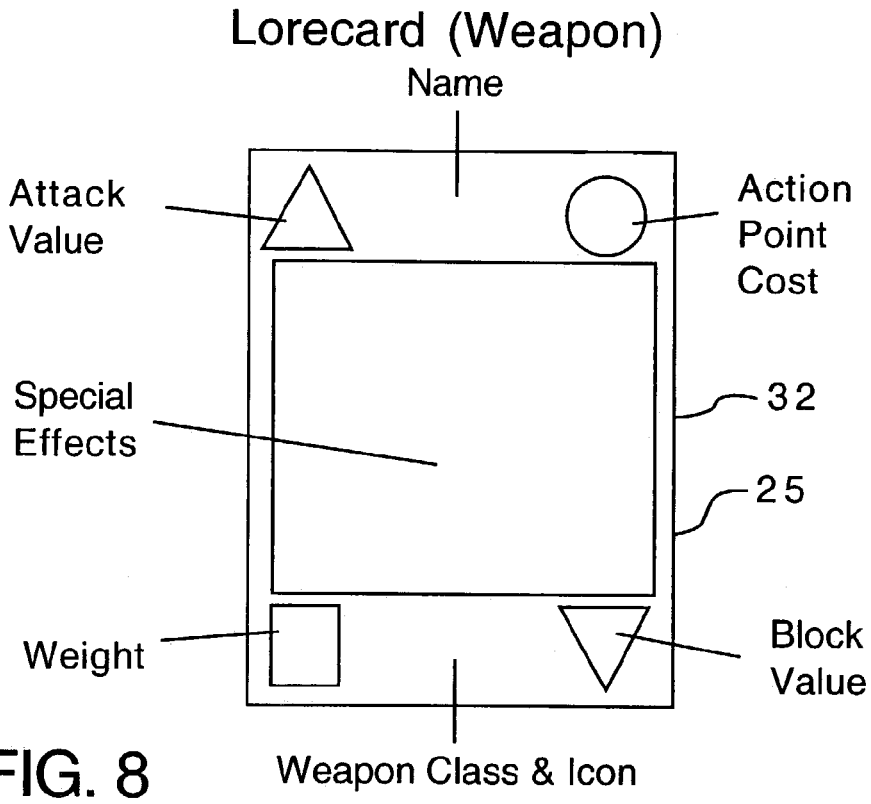

With regard to the weapon Lorecards represented at 25 in FIG. 8, the terms "Weight" and "Block Value" have the same meaning with regard to the afore-referenced armor Lorecards. The classification "Weapon Class & Icon" indicates or represents the damage type and use properties of the weapon selected. For example, whether the weapon is used for slashing, crushing, piercing, whether the weapon is two-handed or whether the weapon is a throwing type weapon. The term "Icon" provides an aid in identification of the weapon with an icon resembling the weapon.

With regard to the "Runecards" represented at 25, 44 in FIG. 10, the term "Range" indicates a value that represents the maximum number of hexes that may be cast by the spell designated or imparted. The term "AoE" designates the area of the effect of the spell. However, not all spells are provided with this attribute. Lastly, the term "Recycle Time" provides a number which denotes the number of full turns that must pass before the spell may be cast again.

In order to play the war game, the chance selection devices, such as the dice (not shown) and/or cards are manipulated by respective opponent players to sequentially chance select what opponent figure body part is to be removed. In other words, this strike by an opponent player on another player's game FIG. 10 designates the removal of a body part of the opponent figure as an attack strike. This particular body part is designated by this selection device which includes dice or cards. The selection device also preferably includes a chart (not shown) designating what body parts are to be removed based on the number selected by throwing of the dice. These body parts struck and removed or severed may also consist of the weapons such as shown in FIGS. 15, 16 and 17, and armor such as illustrated in FIGS. 12 through 14.

The chance selection device, such as dice and accompanying chart designating what parts are to be severed, dictate what particular type of strike is made by the attacking figure. For example, the strike made as designated by the chance selection device indicates what body part (including armor and weapons) is to be severed from the opponent FIG. 10. On defense, the weapons, armor, skills and magic powers of the opponent FIG. 10 may be effective to block respective advancing strike attacks or blows, depending upon the strength designations provided by the cards 25.

The war game is continued in this manner until all game figures are defeated by ultimate removal of a predetermine critical body part, except for the one or more remaining undefeated figures of the winning opponent player. In this particular disclosure, the critical body parts are the two opponent glow sticks 22. Once they are struck and removed then the opponent's game figure is considered terminated. Although typically the game is played whereby body parts, including weapons and armor etc., are removed by chance selection as an attack on an opponent game figure, such body parts may be replaced on a figure upon making concessions, such as through purchase, game point concession or the like.

Only the basic rules of the game have herein been provided in order to minimize confusion and to more specifically point out and define the more important inventive features of the method and apparatus of the present invention.

I claim:

1. A war game for a plurality of opponent players, comprising:

multiple sets of moveable jointed game figures, each set having game player alignment identification indicia;

said figures having removable and replaceable body parts; and chance selection means for chance selection by respective opponent players of body parts of said figures aligned with another opponent to be removed as an inflicted injury based upon designations indicated by said selection means;

said chance selection means including cards having instructions thereon affecting the outcome of the game, said instructions being readable in the dark.

2. The war game of claim 1, wherein said body parts include parts comprised of luminescent plastic.

3. The war game of claim 1, wherein said game figures include at least one body part comprised of a chemical light stick.

4. The war game of claim 3, wherein said chemical light sticks are of different color in order to provide said alignment identification indicia.

5. The war game of claim 1, wherein said body parts are skeletal structure.

6. The war game of claim 1, said figures having removable and replaceable armor and weapons.

7. The war game of claim 1, wherein selected of said body parts indicate different levels character powers of ability.

8. The war game of claim 1 wherein said cards indicate an attribute designated to a game figure of the game player making the card selection, said attributes selected from a group of attributes including skill level, magical powers, weapons and armor.

9. The war game of claim 1, including a game board for positioning said game figures thereon.

10. The war game of claim 1, said chance selection means including dice and a chart designating body parts of said figures to be removed based upon a number indicated by said dice.

11. A method of playing a war game, comprising the steps of:

providing multiple sets of moveable game figures with each set having game player alignment identification indicia and each figure having removable and replaceable body parts;

providing chance selection means for chance selection of respective opponent players of body parts of said figures aligned with another opponent to be removed as an inflicted injury based upon designations indicated by said selection means;

manipulating said selection means by respective opponent players to sequentially chance select what opponent figure body part is to be removed and wherein said manipulating includes the steps of chance selecting a number and then referring to a chart to determine what opponent figure body part is to be removed based upon the number selected;

removing a body part from an opponent figure as directed by said selection means; and continuing in accordance with the above rules until all game figures are defeated by ultimate removal of a predesignated critical body part except for one or more remaining undefeated figures of a winning opponent player.

12. The method of playing a war game according to claim 11, including the step of:

providing at least one body part for said figures which is comprised of a chemical light stick; and designating said at least one chemical stick as said critical body part.

13. The method of claim 12, wherein said light sticks emanate different colors for game figures of different opponent game players for providing said player alignment identification indicia.

14. The method of playing a war game according to claim 11, including the step of providing at least some of said body parts of luminescent plastic.

15. The method of playing a war game according to claim 14, including the step of providing said body parts as skeletal structure.

16. The method of playing a war game according to claim 11, including the step of providing removable and replaceable armor and weapons for said figures.

17. The method of playing a war game according to claim 11, including the steps of providing cards having instructions thereon which are readable in the dark and affect the outcome of the game; and said opponent players sequentially selecting said cards for determining what instructions apply to the figures of the card selector.

18. The method of playing a war game according to claim 17, including the step of designating said instructions as imparting attributes to said game figures selected from the group of attributes including skill level, magical powers, weapons and armor.

19. The method of playing a war game according to claim 11, including the step of replacing a previously removed body part on a player figure as an act of healing earned by strategic choice.

* * * * *